United States Patent [19]

Ward et al.

[11] Patent Number: 4,692,067

[45] Date of Patent: Sep. 8, 1987

[54] CONTROL SYSTEMS

[75] Inventors: Richard Ward, Worsley; Archelaius D. Allen, Preston, both of England

[73] Assignee: Dobson Park Industries Plc., Nottingham, England

[21] Appl. No.: 621,388

[22] Filed: Jun. 18, 1984

[30] Foreign Application Priority Data

Jun. 21, 1983 [GB] United Kingdom ..... 8316838

[51] Int. Cl.[4] ..... E21D 23/12

[52] U.S. Cl. ..... 405/302; 91/170 MP

[58] Field of Search ..... 405/302, 291, 299, 300, 405/301; 91/170 MP; 299/33

[56] References Cited

U.S. PATENT DOCUMENTS

| | | | |
|---|---|---|---|
| 3,306,050 | 2/1967 | Andrews et al. | 405/302 |
| 3,821,880 | 7/1974 | Weirich et al. | 405/302 |
| 3,906,738 | 9/1975 | Weirich et al. | 405/302 |
| 4,226,558 | 10/1980 | Bower et al. | 405/302 |
| 4,327,628 | 5/1982 | Weirich et al. | 405/302 X |

*Primary Examiner*—David H. Corbin

*Attorney, Agent, or Firm*—Murray and Whisenhunt

[57] ABSTRACT

A coal cutting machine 13, a conveyor 12 and a plurality of mine roof supports 10 extend along the face 11 of a coal mine. The operation of the hydraulic jacks of the roof supports are controlled by pilot valves which are electrically powered and rotationally driven. For example, motorized or cam operated pilot valves can be used. Such pilot valves use much less energy than valves controlled conventionally by solenoids, and the electricity supply can thus be at an intrinsically safe level.

The operation of the pilot valves include unitary operation of a given support, remote operation of one support from another and sequential operation of a series of supports. When the system controls a plurality of supports sequentially, sensing means sensitive to a first pressure level in a first support when the first support is set to a mine roof activate another support in the sequence when the first pressure level has been sensed in the first support, while continuing the raising of the pressure in the first support until a second, higher pressure level is detected.

A group of supports is controlled by a control station positioned at a face end, and in addition each support has its own individual control position. The control station incorporates a microprocessor which may be reprogrammed underground.

17 Claims, 16 Drawing Figures

CONTROL SYSTEMS

BACKGROUND TO THE INVENTION

The invention relates to control systems and particularly to control systems for use in controlling mine roof supports.

DESCRIPTION OF THE PRIOR ART

Mine roof supports conventionally comprise a base unit, a roof engaging unit and a plurality of legs in the form of hydraulic jacks extending between the base unit and the roof engaging unit. In modern long wall mining a row of supports is arranged side by side adjacent to a conveyor extending along a mine face from one face end to the other. A coal cutting machine travels back and forth along the face, cutting away a web of mineral on each pass which mineral is fed to a face end by the conveyor. As soon as the coal cutting machine has passed some of the supports during any given pass, those supports are firstly used to push the conveyor forward towards the new face, via a ram connected between each support and the conveyor, are then released from the roof by lowering their legs, are drawn towards the conveyor by retraction of the said ram, and are then re-set to the roof in their new position by raising their legs again. Thus as the coal cutting machine travels along the face the conveyor, which is flexible, gradually snakes over into a new position, followed by the supports.

The supports may additionally have hydraulically operated extension bars or fore-poles on their roof engaging units, which can be extended towards the newly cut face to support the new roof before the support moves forward, and sprags which can be extended to press against the new face itself, i.e. the outwardly facing face as opposed to the downwardly facing new roof.

Most functions of mine roof supports, e.g. fore-pole extend, sprag extend and retract, conveyor advance, legs lower, legs raise, support advance, are hydraulically controlled, because of the dangers associated with electrical equipment underground, e.g. the risk of explosive gases being ignited by sparks. Each support accordingly carries associated hydraulic valve gear.

It is considered unsafe practice nowadays for the valve gear on a given support to be operable to actually perform the functions of that support. The man on the moving support would be exposed to considerable risk from falling debris or dangers created by a malfunction of the support. Accordingly only a limited number of support operations can be carried out from the given support itself, for example fore-pole extend and sprag extend. Actual movement of a support can only be initiated from an adjacent or remote support. As a consequence a mass of hydraulic hoses or ducts extend not only within each support but also from one support to another. It is frequently desired to operate selected functions of supports in batches or groups, further increasing the quantity of hydraulic cables passing along the face.

It would clearly be highly desirable to be able to control mine roof supports electrically because of the considerable reduction in the size of the cable compared with a hose or hoses required and the avoidance of leaks, but there is the safety problem mentioned above.

Limited forms of electro-hydraulic control are available but it has been decided and is mandatory that the power levels must be kept to a very low level, typically a maximum current of 500 milliamps with a 12 volt supply.

Solenoid operated valves are used in electro-hydraulic control but because of the power requirements only a few relatively high powered solenoid valves can be operated at any one time. If a valve is to be maintained in one position after electrical initiation it must be hydraulically latched in the desired position because the electrical power must be removed after initiation for use elsewhere, for example to initiate another solenoid operated valve. Thus at the end of an operation the hydraulically latched valve must be unlatched and if the operation is to be stopped in an emergency it may be necessary to dump the hydraulic flow from the supply pump.

OBJECT OF THE INVENTION

It is the object of the invention to provide a system of controlling a plurality of mine roof supports which permits much greater use of electrical control with hereto unknown resultant versatility.

SUMMARY OF THE INVENTION

Accordingly the invention provides a control system for at least two mine roof support hydraulic jacks wherein selective operation of the hydraulic jacks is controlled by means of pilot valves operated by rotationally driven means.

Preferably the rotationally driven means is electrically powered, and preferably a mechanism with a high mechanical advantage is incorporated in the driven means.

The pilot valves may be cam operated and may be motorised.

The hydraulic jacks may be the jacks of a single roof support but preferably the jacks of an adjacent support or a plurality of supports are controlled.

The selective operation preferably includes one or more of: unitary operation of a given support; remote operation of one support from another; and sequential operation of a series of supports.

We have discovered that such valves are intrinsically safe for use underground and preferably the rotationally driven means is driven through a reduction gearing to reduce power levels to intrinsically safe values.

We have also discovered that the power savings that can be made by using motorised valves for example as fluid control valves means that more power can be made available for operating other valves for allied operations without exceeding the overall intrinsically safe power levels.

It may for example be possible to use sixteen to twenty electrically operated valves on a given support as opposed to say three previously.

Preferably electricity is used to move valves between desired positions in such a manner that the need for hydraulic latching is eliminated.

Preferably the control system includes an emergency stop device arranged to stop electrical operations, thus eliminating the need to divert pump fluid in an emergency.

When the system is used to control a plurality of supports sequentially the system preferably comprises sensing means sensitive to a first pressure level in a first support when the first support is set to a mine roof the control system being operable to activate another support in the sequence when the first pressure level has been sensed in the first support while continuing the raising of the pressure in the first support until a second, higher pressure level is detected. This can significantly speed up the time taken to reposition a group of supports. It is no longer necessary to wait until a first support has been fully set to a mine roof before starting the movement of the next support. Operations on the next support of a sequence can commence as soon as the pressure in the first support has reached a first, safe, level but before the final optimum pressure has been reached.

The sensing means may comprise a two-stage pressure switch system.

Alternatively the sensing means may comprise a device (e.g. a pressure transducer) which generates an electrical signal which has an analogue relationship to the pressure in the associated hydraulic jack.

Preferably a group or bank of supports are controlled by a control station e.g. positioned at a face end although each support may also have its own individual control position.

Preferably the control station incorporates a microprocessor.

Preferably the microprocessor incorporates a ROM arranged to maintain programme parameters even if power is lost.

Preferably the ROM is an EEPROM so that re-programming underground is possible.

Preferably the access to the EEPROM is restricted by a key-operated device, or a security code.

There may be a control station or readout station arrangeable on the surface of a mine but connected to the underground control system.

Other objects, preferred features and advantages of the invention will become apparent from the following description of two embodiments of the invention, given by way of example only.

DESCRIPTION OF EMBODIMENTS OF THE INVENTION

Figure 1:
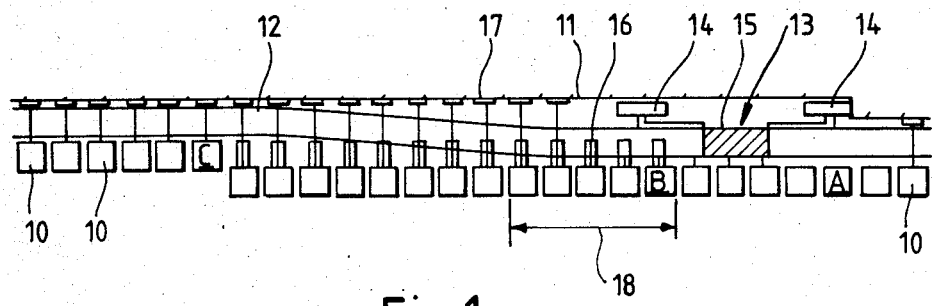
FIG. 1 is a diagrammatic plan view of a long wall mining installation controlled by an embodiment of control system according to the invention.

The installation illustrated in FIG. 1 comprises a series of mine roof supports 10, of which only twenty-six are shown, arranged side by side along the face 11 of a coal mine. Extending along the face between the face and the supports is a conventional conveyor 12. A coal cutting machine 13 having cutting drums 14 at each end is movable back and forth across the face to cut away a web of coal on each pass. In FIG. 1 the machine is moving to the right and the leading drum 14 i.e. the right-hand drum 14 is cutting away a web of coal. The machine is loading the cut coal on to the conveyor 12 adjacent the shaded position 15.

After the cutting machine has passed by, extension bars or fore-poles 16 are extended from the supports 10 to give some support to the mine roof nearer to the newly cut face. Furthermore sprags 17 are moved into position to push against the newly cut face immediately below the new part of the roof.

Each mine roof support comprises a floor engaging unit and a roof engaging unit interconnected by legs in the form of hydraulic jacks. These parts of the supports are conventional and will not be described in detail. When the supports are carrying out their support function the legs are extended to jam the roof engaging unit against the mine roof. Each support is connected to the conveyor 12 by a hydraulic ram and once the coal cutting machine has passed a given support by a predetermined distance, known as the headway distance and illustrated by reference numeral 18, the rams of one or more given supports can be extended sequentially to push the conveyor over to the new face. As shown in FIG. 1 the left-hand portion of the conveyor has been completely moved into the new position and the central portion of the conveyor is gradually snaking over to the new position. Once the conveyor has been moved to a new position each support, in turn, can be released from the roof by lowering its legs, can then advance itself by retracting the ram connecting it to the conveyor, and can then be re-set in its new position by raising the legs again. As each support advances its extension bar or fore-pole 16 can be retracted, and the sprag 17 repositioned in the support.

The various functions of each support, which involve the use of hydraulic rams, have conventionally been controlled by solenoid operated valves which each typically require 100 milliamps of current at 12 volts to drive the valves. As a safety precaution a maximum current of 500 milliamps is permitted and so only a few solenoid operated valves can be used at any one time. The maximum 500 milliamp current has to drive not only the solenoid operated valves but any other electrical equipment and so up to now it has only been possible to make very limited use of microprocessors, electrically operated valves and system monitoring devices such as pressures switches.

We have now developed a new motor driven valve which is described in our co-pending patent application No. 8307541 now published printed patent specification No. 2118688A and it is this valve which is used on the installations shown in the accompanying Figures of this application.

Figure 9:
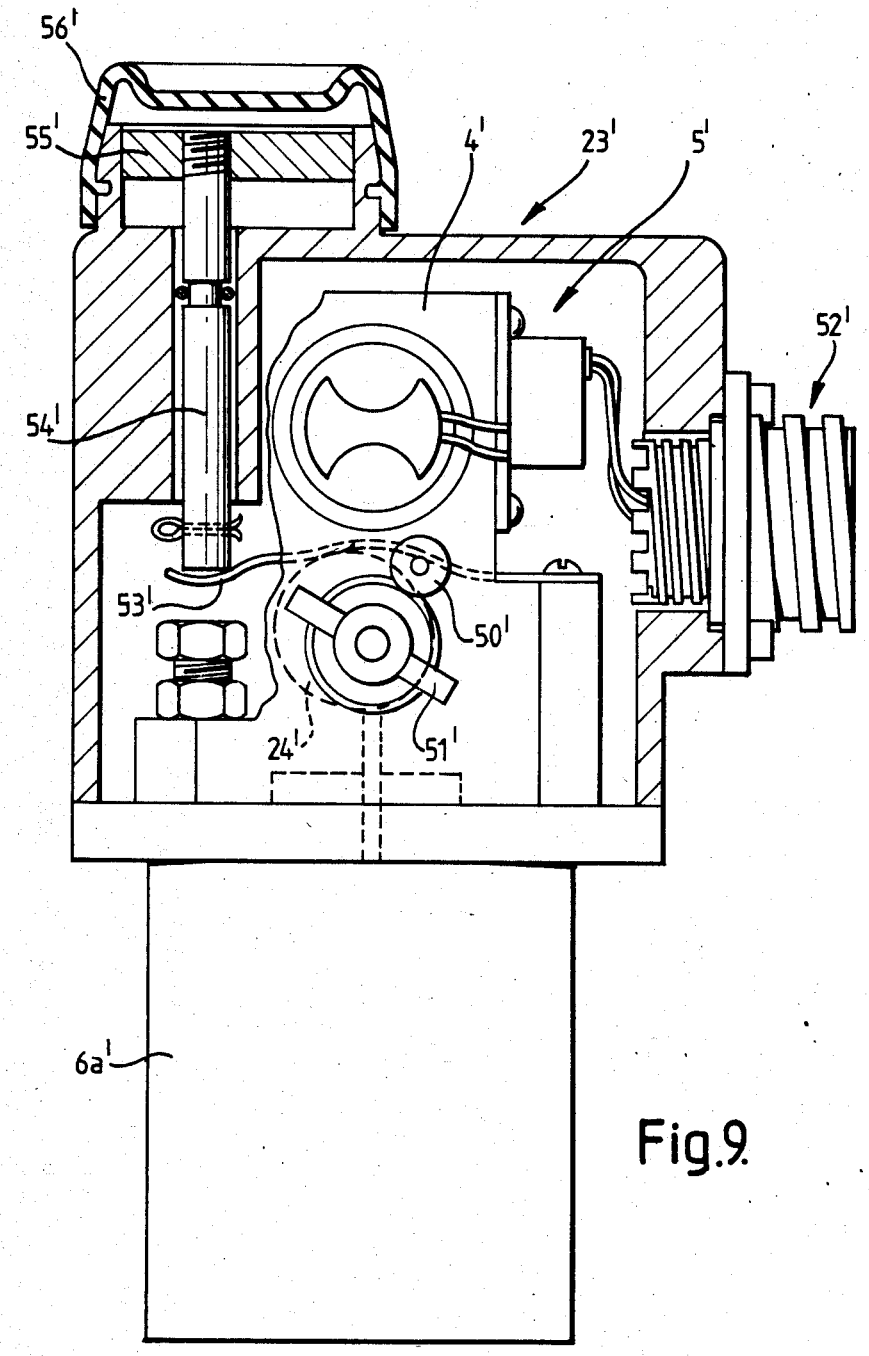
FIGS. 9 and 10 are cross-sectional through the motor driven valve of our co-pending U.K. Patent Application No. 8307541 and now published printed patent specification No. 2118688A
Figure 10:
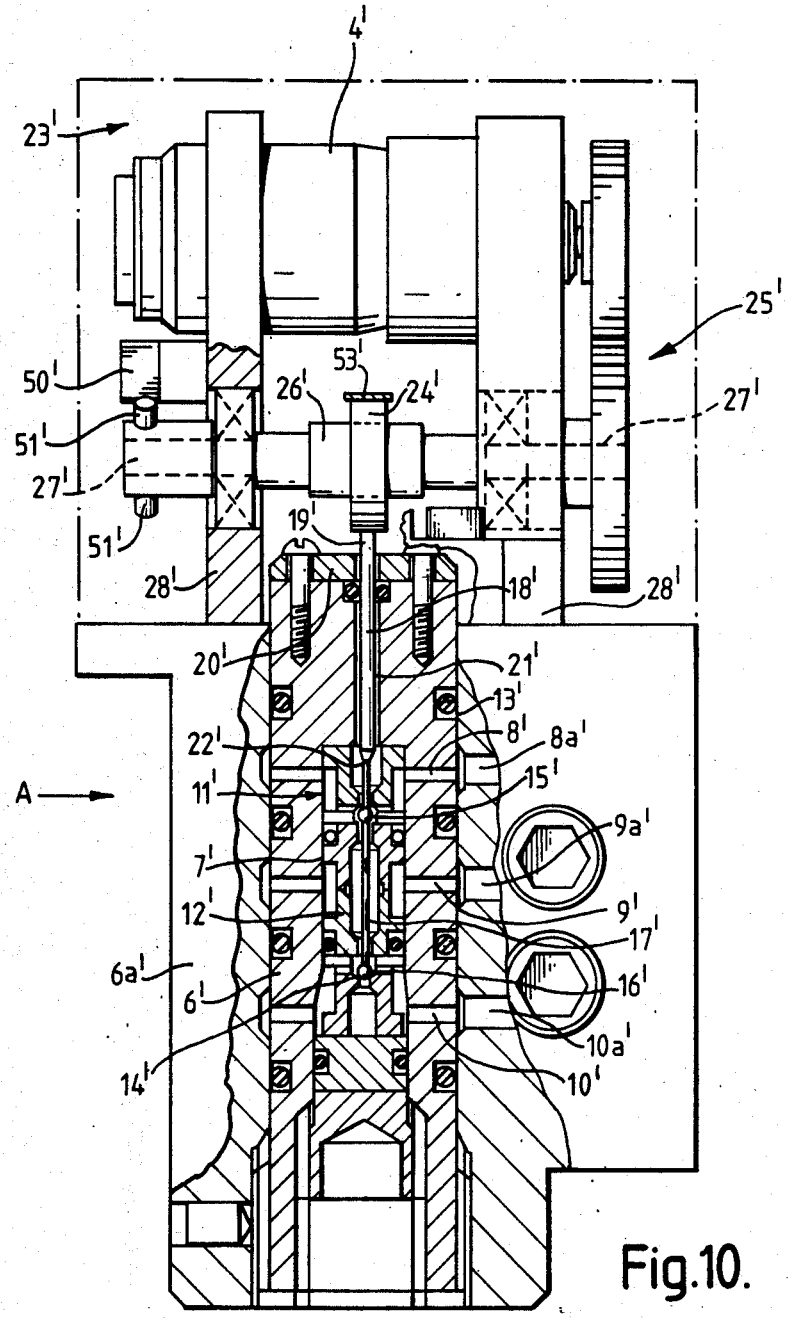

Cross-sectional views through the valve are shown in FIGS. 9 and 10. Referring to FIGS. 9 and 10, each valve 3', which may have an aperture of say 0.04" (0.1 cm) and may be arranged to operate with hydraulic fluid at a pressure of say 100 to 400 bar, is a three-port ball valve. The valve 3' comprises a cylindrical valve body 6' which is screwed into a solid housing 6a' and has an axially extending bore 7' therethrough and three sets of passages 8', 9', 10' extending radially between the bore 7' and annular spaces which communicate with three ducts 8a', 9a', 10a' extending radially through the housing 6a' at axially spaced positions. Within the bore 7' there is adjustably mounted an encapsulated valve assembly 11' comprising a tubular body 12' with central valve seats 13', 14' at opposite ends thereof, two balls 15', 16' movable respectively into sealing engagement with the two valve seats 13', 14' and a push rod 17' extending axially between the balls 15', 16'. The valve assembly 11' is located within the bore 7' such that the two outermost sets of passages 8', 10' communicate respectively with the bore 7' beyond the two valve seats 13', 14' and the central set of passages 9' communicate with the bore 7' between such seats 13', 14'. Above the valve assembly 11' a further push rod 18' is axially slidably mounted with a bore 21'. The upper end 19' of this rod 18' projects beyond the top 20' of the valve body 6'. The lower end 22' of the rod is of reduced diameter and projects through the top valve seat 13' for engagement with the pertaining top ball 15'.

On the top end 20' of the valve body 6' there is mounted a motor compartment 23'. This compartment has therein the pertaining regulating circuitry 5' and electric motor 4'. Also, the compartment contains an eccentric 24' and a gear train 25'. The eccentric 24' is fixed to a sleeve 26' which is fixed in turn to an axle 27' which is rotatably mounted between brackets 28' secured to the top of the valve housing 6a' such that the periphery of the eccentric 24' engages the top end 19' of the push rod 18'. If desired, a return spring (not shown) may be coupled to the axle 27' to urge same in one direction of rotation. The axle 27' is drivably connected via the gear train 25' to the motor 4' and a fixed stop 50' is mounted on one end of the axle 27' for limiting the rotation of the axle in each direction.

The compartment 23' is sealed and a screw socket 52' is provided to permit connection of an external cable to the internal circuitry 5' and motor 4'.

The compartment further contains a manual override device comprising a leaf spring 53' which is fixed at one end and at its opposite end fits freely beneath a push rod 54' which is vertically slidable within a bore formed in the compartment structure. The push rod 54' is connected at its upper end to a button 55' which is covered by a flexible rubber boot 56'. The leaf spring 53' passes over the eccentric 24' and can be moved downwardly against the resilience of the spring, by pushing the button 55' through the boot 56', to bear against and effect rotation of the eccentric 24'.

The bottom set of passages 10' of the valve is connected to a source of pressurised fluid and the upper and central sets of passages 8', 9' are connected respectively to a drain outlet and to a main valve (not shown) to be hydraulically controlled by the valve 3'. The motor 4' and regulating circuitry 5' may be connected remotely to a control box as described below.

The arrangement may be such that the valve 3' is held in the "on" position when the motor 4' is powered. That is, the motor 4' drives the eccentric 24' (against any return spring) via the gearbox 25' to one limit position at which the push rod 18' is moved down to the lowermost position of its travel and the eccentric 24' is short of its dead centre position, such that the top seat 13 is open and the bottom seat 14' is closed thereby to permit flow of hydraulic fluid in through passage 9' and out through passage 8', and the motor 4' stalls in this position. Having regard to the nature of the motor 4' and the affect of the constant current circuit it is possible to hold the motor 4' in the stalled position for any required period of time without damage to the motor or any overheating or other problem likely to constitute a safety risk. When power is disconnected from the motor 4' the push rod 18' rises to its uppermost position and the eccentric rotates back through slightly less than 180° to its other limit position at which the bottom seat 14' is open and the top seat 13' is sealed thereby permitting flow of fluid from the passage 10' to the passage 9'. The push rod 18' is lifted by the fluid pressure, and rotation of the eccentric 24' is facilitated by the action of the return spring, where fitted, (especially in low pressure applications) and also by the low friction contact between the eccentric 24' and the tip 19' of the push rod 18'.

Figure 2:
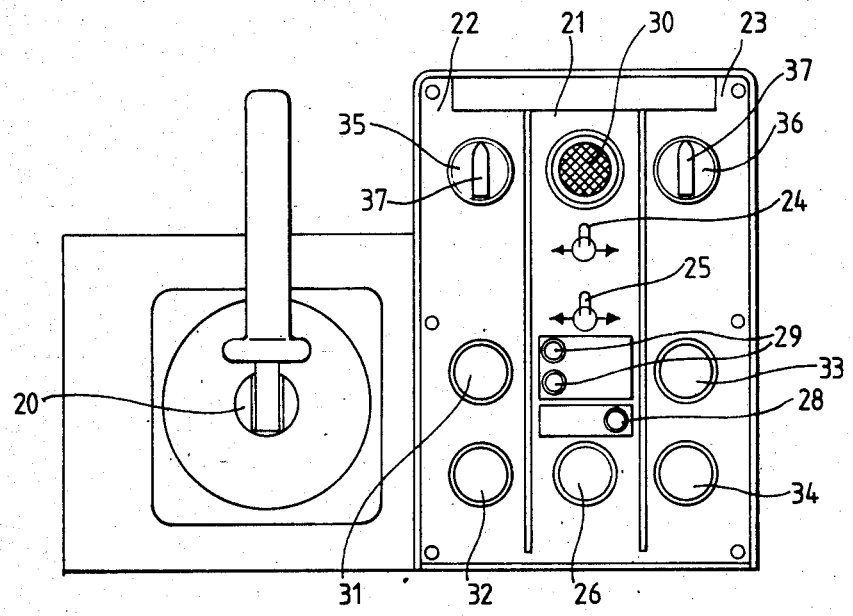
FIG. 2 is a front view of the controls for an individual mine roof support.

The new valve requires a current of typically only 12 milliamps and so it is possible to use a large number of valves and we have now discovered that this makes it feasible to equip each mine roof support with its own electronic control box as illustrated in FIG. 2. The box is coupled to a conventional manual selection valve 20 in case manual overide is required.

It will be seen that the control box has three sections, namely a central section 21, a left-hand section 22 and a right-hand section 23. The central section 21 has an on-off switch 24 and a mode switch 25 which can be set either to a local position for controlling local supports individually, or to an automatic position in which case control becomes part of a sequence controlled from an overall control station described below.

The central section 21 also has a button 26 which can be pressed to enable the associated support to advance, although the actual advance operation must be initiated from elsewhere, either an adjacent support or a central control station since it is not regarded as safe practice for an operator to be able to actually move the support that he is under. The central section 21 also incorporates three visual warning lights, one 28 to indicate whether advance has been enabled, and two 29 to indicate whether or not the control box has accepted or rejected the command given to it. There is also an audible warning device 30 which emits an audible warning a few seconds before the associated support begins to move, for the safety of any operatives who are in the vicinity of the support at the time.

Some operations of the support may be controlled directly from the support itself and these include the extension of the fore-pole, which is initiated by pressing a button 31 in the left-hand section 22. There is a further pushbutton 32 in the section 22 for use in extending the ram coupled between the support and the conveyor, in order to advance the conveyor.

The right-hand section 23 also has two pushbuttons, one 33 for use in initiating a sequence of operations controlled by a programme described below, and one 34 for stopping the operations, for example in an emergency.

Since it is often obligatory from the safety point of view to be able to move adjacent supports from a given support the left-hand section 22 incorporates a control device 35 associated with the left-hand adjacent support and the section 23 incorporates a control device 36 associated with the right-hand adjacent support. Each control device comprises a knob rotatable clockwise or anti-clockwise as desired by turning a projecting lug 37. If the knob 35 is turned clockwise it advances the adjacent support and if it is turned anti-clockwise it raises the legs of the adjacent support to re-set it. With the knob 36 anti-clockwise movement advances the right-hand support and clockwise movement raises the legs of the right-hand adjacent support. Each knob is springloaded into the position shown in FIG. 2 to provide a 'deadman's handle' feature.

Figure 3:
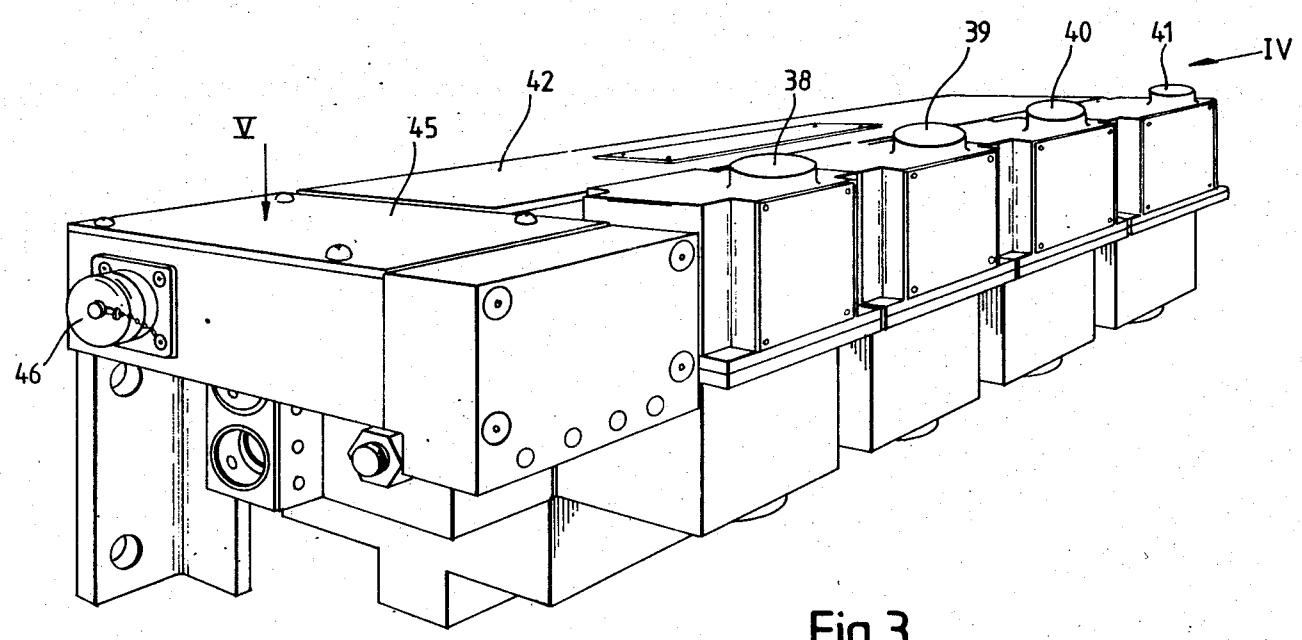
FIG. 3 is a perspective view of valve gear for a support.
Figure 4:
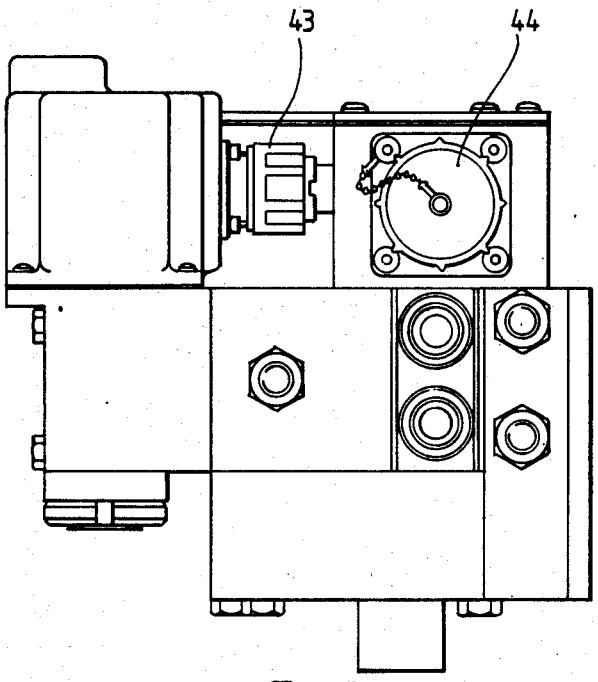
FIG. 4 is a view in the direction of arrow IV of FIG. 3.

The actual valves for a given support, which as mentioned above are each of the form described in our co-pending patent application No. 8307541, now published printed patent specification No. 2118688A are arranged in a housing as shown in FIG. 3. There are four valve chambers 38 to 41. Chamber 38 contains a valve controlling the extension of the fore-poles, chamber 39 contains valve controlling the raising of the legs to re-set the support in position, chamber 40 contains a valve to control the advance of the support (lowering of the legs takes place automatically immediately prior to advance) and chamber 41 contains a valve controlling the extension of the ram to push the conveyor into a new position. Each valve is connected to a common terminal chamber 42 by a connection 43 (see FIG. 4). Terminal chamber 42 in turn has a connection 44 which is shown covered in FIG. 4 but in use will be connected to the associated control box. Terminal chamber 42 is also coupled to a further terminal chamber 45 which has a connection 46 (shown covered in FIG. 3) which in use is connected to a transducer which monitors the position of the ram coupled to the conveyor and hence monitors the position of the support when it is moving.

Figure 5:
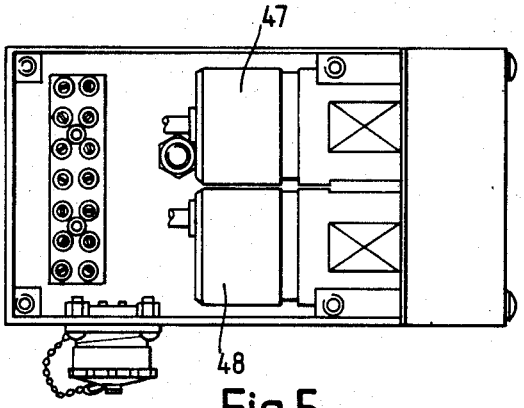
FIG. 5 is a part view on arrow V of FIG. 3 with a cover removed.

Within the terminal chamber 46 there are two pressure switches 47 and 48 as shown in FIG. 5. Switch 47 is set to detect a pressure which is regarded as the optimum to be achieved for final positive setting of a support to the mine roof. When this pressure is detected the flow of further hydraulic fluid to the legs of the support will be terminated. If however each support is set to its final maximum pressure before the next support is moved, which is what happens with a conventional installation, then the time taken to carry out a complete sequence of operations is quite considerable. Consequently this embodiment of the invention incorporates the second switch 48 which is set to operate at a slightly lower, but nevertheless safe, pressure. Thus once any given support has safely engaged the roof the movement of the next support can commence immediately although hydraulic fluid will still be fed to the first support until it reaches its final optimum setting pressure.

If desired the two switches 47 and 48 may be replaced by analogue pressure transducers which will produce a signal related in an analogue manner to the pressure in the legs of the support and this signal can be used to trigger the movement of an adjacent support as soon as a safe pressure has been achieved.

Figure 6:
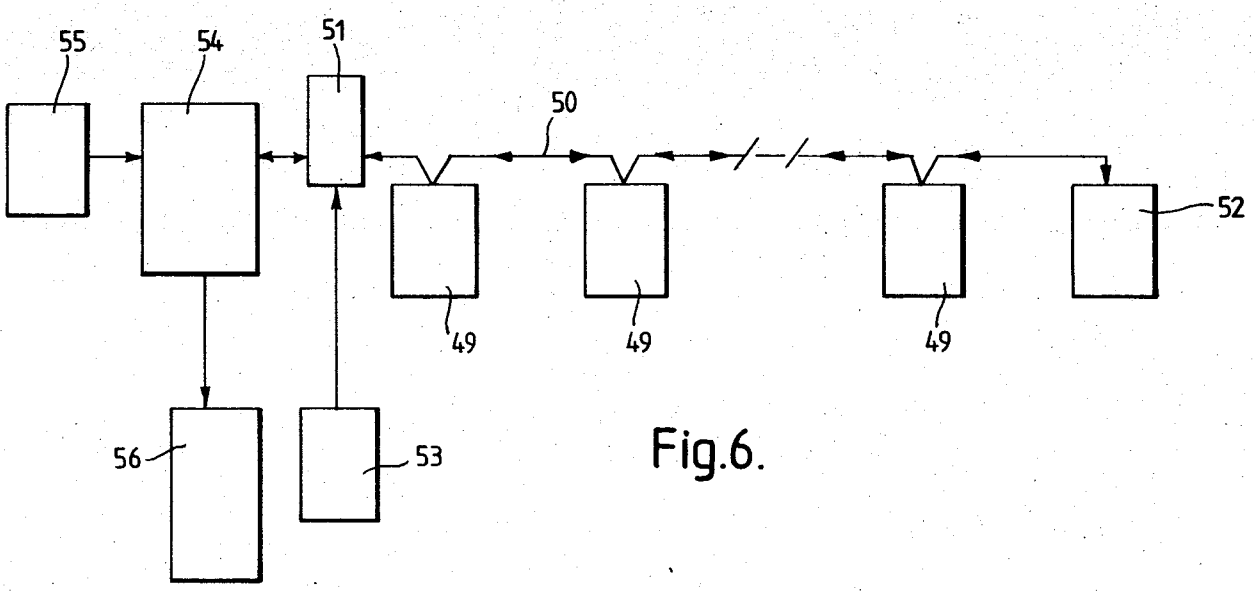
FIG. 6 is a diagrammatic illustration of the electrical connections for the embodiment of the system.

Turning now to FIG. 6, there is a plurality of control boxes 49, one for each roof support of a face, coupled together by cable 50. At one end face the cable is connected to a gate end unit 51 and at the other end to a terminator unit 52. There is a 12 volt 500 miliamp power supply 53 for the gate end unit 51.

The gate end unit 51 is connected to a control station in the form of a gate end computer 54 which has its own low level power supply 55. The gate end computer 54 also has a display 56 and in addition to there being a gate end display there may be a display at the mine surface.

Figure 7:
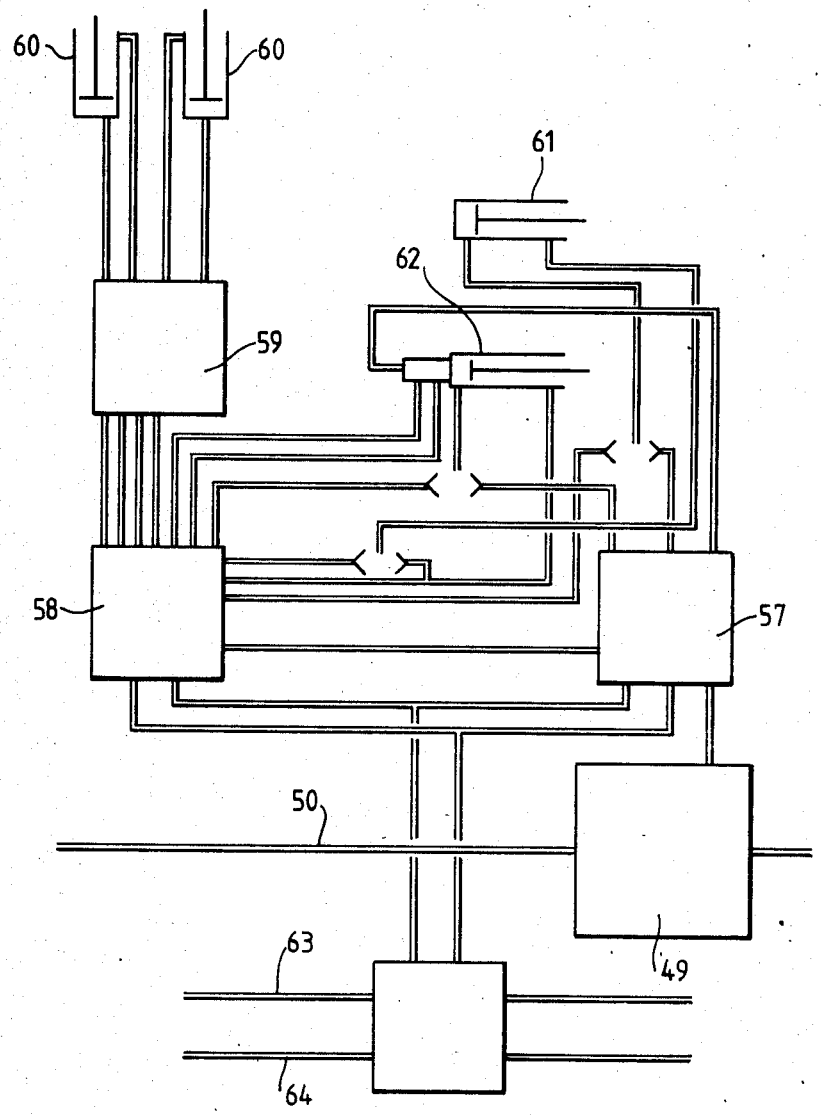
FIG. 7 is a similar diagrammatic illustration but also illustrating the hydraulic layout.

FIG. 7 illustrates additionally hydraulic circuitry associated with one support. The other supports will be arranged similarly. One control box 49 is shown with the cable 50. The control box 49 is connected to the block of valves 57 which in practice will be as shown in FIG. 3. The valve block 57 is also connected to the conventional manual overide valve gear 58. The valve gear 58 is connected via a conventional non-return valve manifold 59 to the legs 60 of the support. The valve block 57 and manual valve gear 58 are also coupled up as shown to the fore-pole extension ram 61 and the ram 62 which connects the support to the conveyor.

Hydraulic fluid is supplied to the solenoid block 57 and manual valve gear 58 via a feed line 63 and return line 64.

A typical series of operations that can be carried out with this embodiment of the invention will now be described with reference to FIG. 1.

As the coal cutting machine 13 travels to the right as shown in FIG. 1 an operator on support A retracts the face sprags 17 at a predetermined distance in front of the leading cutting drum 14 of the machine. This distance can be preselected on the face by appropriate programming of the gate end computer 54.

An operator at support B advances fore-poles behind the leading drum of the coal cutting machine and sets the face sprags behind the trailing drum (the positions of which are also programmable). He will also sequentially initiate conveyor advance by pressing the appropriate buttons 32. This initiation will be preprogrammed to be on predetermined supports which are designated as pushers (say, every support in two, or every support in four, etc). If the operator has not advanced the conveyor for a predetermined number of supports the gap that he has left will be automatically filled (up to a maximum of, say, five pushers at one time). The above operations can be arranged to have a fixed headway if required as illustrated by the reference numeral 18 in FIG. 1. This headway distance is also preprogrammable on the face.

The operator at B will also sequentially prime all supports to enable them to advance by pressing the appropriate buttons 26. This will hold the enabled supports in preparation for an actual, separate, support advance operation.

An operator at support C is in control of this support advance. He follows behind, advancing the supports that have been previously enabled by pressing the sequence start buttons 33. Advancing will continue sequentially in the same direction as machine travel. Advancing can be stopped at any time but restarting must be carried out from the last support to have advanced. The sprags and fore-poles are arranged automatically to retract during support advance. Sprags can be reapplied either automatically or manually by the man at support C.

All the support operations have the following:

Pre-start audible warnings prior to and during the advance of supports.

Pre-start audible warnings prior to conveyor advance operations.

Pre-start audible warnings prior to fore-pole extend operations.

Pre-start audible warnings prior to face sprag extend operations.

Pre-start audible warnings prior to face sprag park or retraction operations.

The system can be programmed to provide bi-directional control so that the sequence of operations described can be carried out from left to right or vice versa.

The functions described for on face sequential control operation are performed under the control of the gate end computer. The computer is made aware of the position of the coal cutting machine by the buttons that are pressed by the operators on the face. However the facility is provided for automatically transmitting the position of the machine to the gate end computer, for example using the device described in our co-pending patent application No. 8230077 now published printed patent specification No. 2129032A so that the whole sequence can, if desired, be carried out automatically, provided that the controls are in the automatic mode.

In U.K. patent application No. 82 30077, there is described a mining apparatus shown in FIGS. 11–16 comprising mine roof supports 2'' which each consist of a base unit 11'' and a roof engaging unit 4'' supported by hydraulic legs 10''. The base unit 11'' of each support 2'' contains a hydraulic ram 12'' for advancing the mine roof support 2'' and there is a conveyor 14'' to which the front end of each ram 12'' is attached. A face cutting machine 6'' is guided on a rail 16'' on the conveyor 14'' to cut material from the seam 8''.

Figure 13:
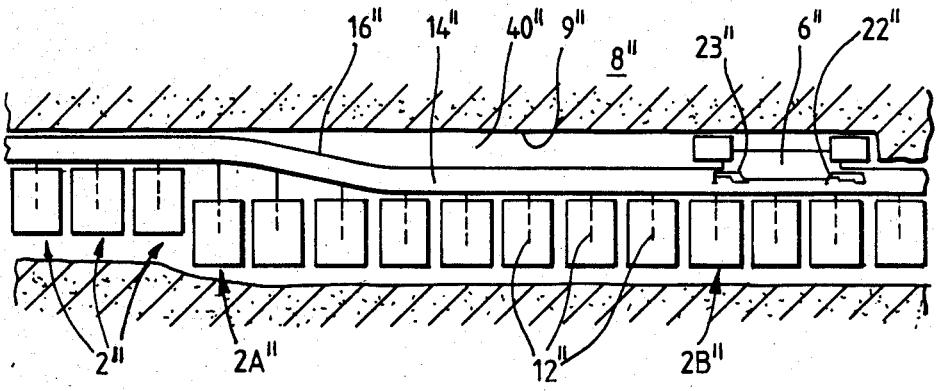

As best seen in FIG. 13, the conveyor 14'' extends along the face 9'' of the seam 8'' to receive material cut away by the machine 6'' and convey it to roadways (not shown) positioned at each end of the face. The machine 6'' is travelling from left to right as viewed in FIG. 13, cutting away a web of material and leaving a gap between the conveyor and the face. The conveyor and attached supports are subsequently moved forward. Each support is operated to extend its ram 12'' and since the support is wedged between the mine roof and mine floor, the legs 10'' being extended, the conveyor is pushed forward. The legs 10'' are then lowered, freeing the support. The ram 12'' can then be retracted, drawing the support towards the conveyor, and finally the legs 10'' can be raised again to set the support in the new position.

It is desirable to advance each mine roof support as soon as possible after the cutting machine has passed, in order to support the new area of roof created by the extraction of material and to prevent debris falling from the roof into the path of the conveyor. However in order not to trap the face cutting machine between the conveyor and the face it is necessary to leave a space 40'', known as the machine headway, behind the machine as it travels along the face. Hence the conveyor moves forward in a snake-like or undulating manner. In FIG. 13 the supports to the left of the Figure have already moved and the other supports will follow suit successively.

In order to maintain an adequate headway, usually equivalent to the width of five or six supports 2'', particularly when the supports are advanced automatically, it is desirable to be able to monitor the position of the machine 6''.

According to one embodiment of that device, position monitoring is carried out using a transmitter and receiver unit 18'', 20'', and a wave guide 22''.

Polarised microwaves or radiowaves are produced by the transmitter 18'' and when directed substantially towards the entrance 34'' of the wave guide 22'' they are accepted by the wave guide, the entrance 34'' being aligned so as to receive waves of the same vertical polarisation 30'' as those produced by transmitter 18''.

The wave guide bends the accepted waves by means of a curved portion 28'' and then rotates the plane of the polarisation through 90° by means of a twist 24''. After being bent again by a further curved portion 26'' the microwaves or radiowaves are emitted from exit 36'' with horizontal polarisation as shown by the arrow 32''. The dimensions of the wave guide 24'' are related to the distance between the transmitter 18'' and detector 20'' such that waves emerging from the exit 36'' reach the detector 20'' which is arranged to detect only horizontally polarised waves.

Figure 11:
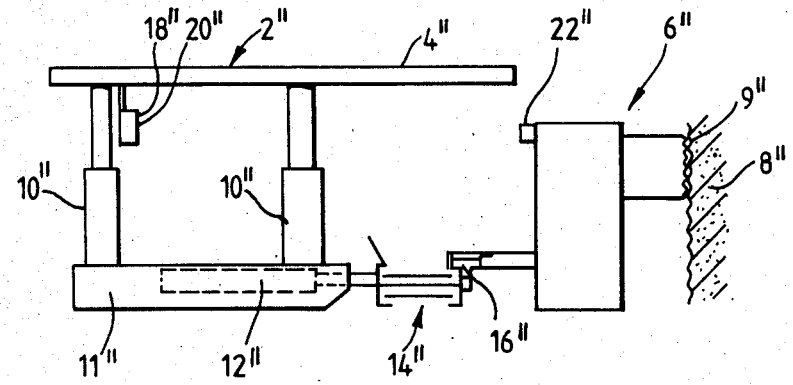
FIGS. 11 through 16 illustrate the movement monitoring device of our U.K. patent application number 8230077.
Figure 12:
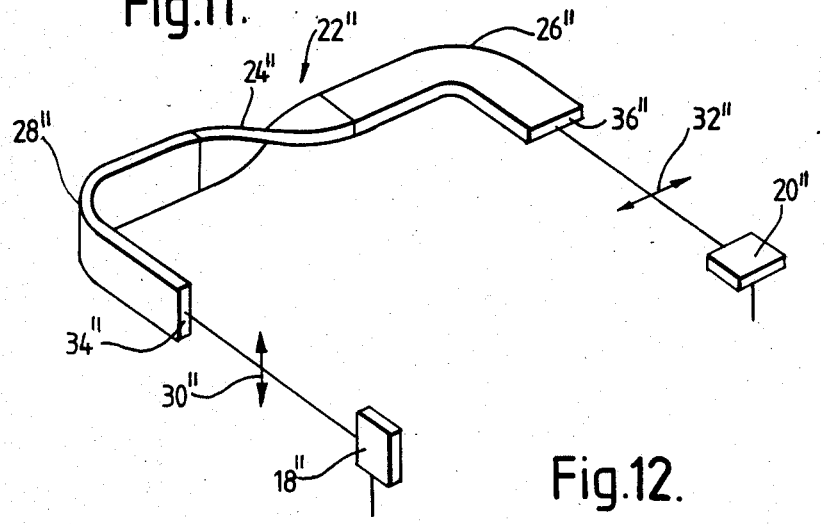
Figure 16:
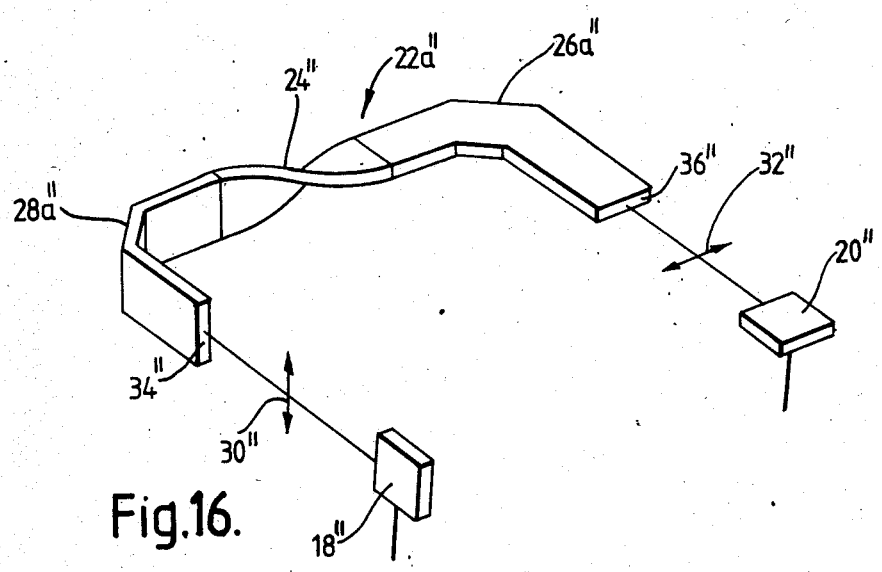
Figure 14:
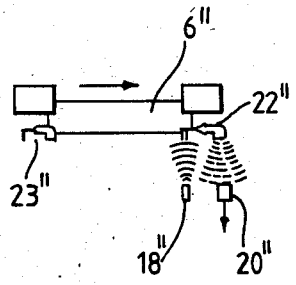
Figure 15:
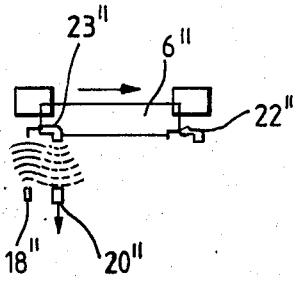

In use a transmitter and detector unit 18'', 20'' is mounted on each support 2'' as shown in FIG. 11. The wave guide 22'' is mounted at the right hand edge of the machine 6'' so that the position of this edge can be monitored. A second identical wave guide 23'' is mounted on the opposite edge of the machine as shown in FIGS. 13, 14 and 15, so that the position of this edge can also be monitored.

Because each wave guide carries out an operation on the received waves, the waves emerging from the wave guides are unique, and only these unique waves will be detected by the detector 20''. Thus if vertically polarised waves from the transmitter 18'' are reflected or scattered from surrounding equipment or the mine face itself they will still be vertically polarised. The detector 20'' will not therefore detect them and give a false reading.

The signals received by the detector 20'' of the various supports can be put to various uses. For example the passage of the trailing edge of the machine past one support 2B'' may be used to indicate that it is safe to advance another support 2A'' which is downstream of the one support 2B'' by the desired length of the machine headway.

If the machine should stop it will still return signals to the nearest support so the position of the stopped machine can still be detected.

Measurement of the time lapse between signals returned by the leading and trailing edges of the machine can be used to measure the speed of the machine, as can measurement of the time lapse between signals received by spaced apart supports.

Measurement of the time lapse between transmission and receipt of a wave may also be used to monitor and possibly control the position of a support in its direction of advance.

The system described gives greater safety to personnel working on the face, better support cycling times, due to improved response times, increased reliability, and the ability to control more effectively the face production operations by selection of the correct computer programs to suit the prevailing mining method.

Each control box of each support contains its own dedicated microprocessor so that even if the gate end computer should go out of service for any reason, the individual control boxes can still be used to control the supports.

The gate end computer can be provided with various pre-planned programmes and programming parameters can be varied. Preferably the gate end computer is provided with two pushbutton control panels, one controlling general operations with unrestricted access and the other controlling selection or modification of programmes, this other control panel having restricted access to authorised personnel only by means of a key. Alternatively, or in addition, a security code may be provided.

The gate end computer incorporates an EEPROM which retains the programme parameters even in the event of a power failure.

It will be appreciated that since many of the connections on supports and between supports are now electrical, there is a significant saving on the required number of internal hydraulic hoses on a support and the number of hoses required from support to support.

The flexibility given by the system makes it possible to carry out different forms of operation at different parts of a face or on different faces. For example in one area locally controlled operations may be carried out while remote control or sequential operations may be carried out at a different location.

Figure 8:
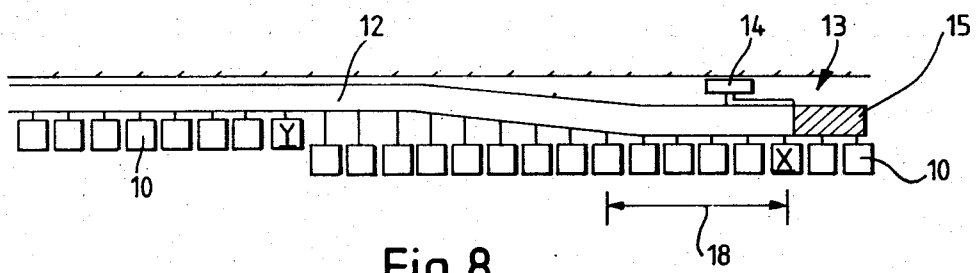
FIG. 8 is a view similar to FIG. 1 but illustrating an alternative embodiment.

FIG. 8 is a similar view to FIG. 1 but illustrating a simpler series of operations where face sprags are not required.

An operator at support X follows the power loader of the coal cutting machine, operating fore-poles within each support by pressing the fore-pole extend button 31. Any preceding fore-poles behind the direction of travel that have not been initiated by the operator will do so automatically up to a pre-programmable maximum of, say, four.

Similarly the same man following the machine will sequentially initiate conveyor advance by pressing the conveyor advance buttons 23. This initiation may again be on predetermined supports which are designated as pushers. Once again, if the operator has not advanced the conveyor for a predetermined number of supports the gap will be automatically filled in. Once again there can be a predetermined headway distance 18 which is pre-programmable. The man following at support X will also sequentially prime all supports to the advance enable condition by pressing the buttons 26.

A second operator at support Y will follow behind advancing the enabled supports by pressing the sequence start button 33. Advancing will continue sequentially in the same direction as machine travel. Advancing can be stopped at any time but once again restarting must be from the last support to have advanced.

Once again there are audible pre-start warnings prior to, and during, supports advancing, prior to conveyor advance operation, and prior to fore-pole extend operation.

Apart from the sequential operations described above, the supports may also be operated in the local mode by appropriate selection of the switch 25.

For example when the conveyor advance button 32 of a support is pressed, the relevant ram will be pressurised and pushing of the conveyor will continue until electrical feedback from the ram indicates that the ram is fully pushed out. For effective pushing of the conveyor several supports will need to have their buttons 32 operated locally in a progressive manner along the coal face.

If the fore-pole extend button 31 of a support is pressed in the local mode then the fore-pole on that support will extend. The relevant electro-hydraulic initiator valve will remain energised for a number of seconds to ensure that the fore-pole is fully extended.

Furthermore adjacent supports may be operated as described previously. If the adjacent advance position is selected the associated support will go through a hydraulic sequence of legs lower, advance and legs set. Should the support need to be reset part-way, during the stroke, for example to level up a line of supports which have got slightly out of sequence, or to re-align the face, the legs raise position is selected and the support will set to the roof at that point. This is often achieved by a linear measuring device embodied in the ram 62 which initiates the legs raise at a pre-determined position of ram extension. Leg setting pressure is confirmed to the electronic system by pressure switches. This also indicates that the operation is complete. As will be appreciated from the description of the control box, such adjacent support advancing operations operate on the 'deadman's handle' principle.

Thus it will be appreciated that the system has the built-in capacity for switching modes of operation between machine initiated control, on-face sequential pushbutton operation and straightforward adjacent control of supports.

Remote support operation from a dust-free area could also be achieved.

The gate end computer can also be arranged to store and display events and alarms related to on-face activities. For example a rolling log of support operations may be maintained at the face and end and may be displayed or transmitted to the surface of the mine as required. Furthermore the computer is arranged to display alarm situations, such as supports not set correctly to the roof.

There may also be a remote manual control at the computer which allows an operator to correct for low leg pressures from the face end, prior to commencing a cutting cycle.

The advantages of the system are numerous but include: more flexibility of operation on the face, with several sequential or adjacent operations being possible at any one time; the elimination of hydraulic (self-holding) valves, as each function can be held on electrically; and the simplification of the emergency stop facilities.

In other words hydraulic latching of valves can be eliminated, thus avoiding the complication of cancelling latched valves.

More sequential operations can be carried out at any one time, for instance the number of extension bars or fore-poles which can be operated quickly and the number of supports designated as pushers which can be used at any one time.

In emergency stop conditions there is no longer any need to dump the pump flow to terminate hydraulically latched operations. Emergency stop buttons can merely used to stop electronic operations.

It is also the fact that greater use can be made of electronic control that makes it possible to use the two-stage pressure switch system. The lower pressure may for example be 1200 p.s.i. and the higher maximum setting pressure may for example be from 2000 to 5000 p.s.i.

The invention is not restricted to the details of the foregoing embodiments.

We claim:

1. A mine roof support system suitable for use along a working face of a long wall mining operation, said working face having first and second face ends, said system comprising:

a plurality of mine roof supports, each support comprising:

hydraulic rams for controlling the height of said support;

hydraulic valve means for controlling said hydraulic rams; and rotary electric motor means for operating said hydraulic valve means; and control means for controlling said system, said control means including:

an electronic control box mounted on each mine roof support; and face end computer means positioned at at least one of said first and second face ends, said computer means being connected to said electronic control boxes for receiving control signals from said electronic control boxes and for transmitting control signals to said electronic control boxes.

2. A mine roof support system as claimed in claim 1, wherein said control means includes a face end unit connected between said computer means and said control boxes and also connected to said rotary electric motor means, a first power source connected to said face end unit for supplying power to said rotary electric motor means, and a second power source connected to said computer means for supplying power to said computer means.

3. A mine roof support system as claimed in claim 1, wherein said rotary electric motor means incorporates a mechanism with a mechanical advantage.

4. A mine roof support system as claimed in claim 2, wherein said mechanical advantage is achieved through a reduction gearing to reduce power levels to intrinsically safe values.

5. A mine roof support systems as claimed in claim 1, in which said hydraulic valve means includes cam operated pilot valves.

6. A mine roof support system as claimed in claim 1, in which said face end computer means effects one or more of:

(a) unitary operation of a given support;

(b) remote operation of one support from another; and (c) sequential operation of a series of supports.

7. A mine roof support system as claimed in claim 1, in which said control means includes an emergency stop device arranged to stop electrical operations.

8. A mine roof support system as claimed in claim 1, including sensing means sensitive to a first pressure level in one of said mine roof supports when said one support is set to a mine roof, the system being operable to activate a second of said supports in sequence when said first pressure level has been sensed in said one support while continuing raising of pressure in said one support until a second, higher pressure level is detected.

9. A mine roof support system as claimed in claim 8, in which said sensing means comprise a two-stage pressure switch system.

10. A mine roof support system as claimed in claim 8, in which said sensing means comprise a device for generating an electrical signal which has an analog relationship to the pressure in the associated hydraulic ram.

11. A mine roof support system as claimed in claim 10, in which said device comprises a pressure transducer.

12. A mine roof support system as claimed in claim 1, in which said computer means incorporates a ROM arranged to maintain program parameters even if power is lost.

13. A mine roof support system as claimed in claim 12, in which said ROM is an EEPROM so that reprogramming underground is possible.

14. A mine roof support system as claimed in claim 13, in which access to said EEPROM is restricted to a key-operated device.

15. A mine roof support system as claimed in claim 13, in which access to said EEPROM is restricted by a security code.

16. A mine roof support system as claimed in claim 1, in which there is a control station or read out station arrangeable on the surface of a mine but connected to the control system located on the ground.

17. A mine roof support system suitable for use along a working face of a long wall mining operation, said working face having first and second face ends, said system comprising:

a plurality of mine roof supports, each support comprising:

hydraulic rams for controlling the height of said support;

hydraulic valve means for controlling said hydraulic rams; and rotary electric motor means for operating said hydraulic valve means; and control means for controlling said system, said control means including:

an electronic control box mounted on each mine roof support, each control box having means for controlling some but not all of the functions of the support on which it is mounted, and means for controlling at least some of the functions of at least one adjacent support;

face end computer means positioned at at least one of said first and second face ends of said working face, said computer means being connected to said electronic control boxes for transmitting control signals to said electronic control boxes; and manually operable priming means connected to each control box for enabling each support to operate in response to control signals from said face end computer means.

* * * * *